US006038896A

United States Patent [19]

Chamberlain et al.

[11] Patent Number: 6,038,896

[45] **Date of Patent: *Mar. 21, 2000**

[54] LOCKSET WITH MOTORIZED SYSTEM FOR LOCKING AND UNLOCKING

[75] Inventors: L. C. Derek Chamberlain; Frederick M. Hensley, both of Colorado Springs, Colo.

[73] Assignee: Schlage Lock Company, San Francisco, Calif.

[ * ] Notice: This patent is subject to a terminal disclaimer.

[21] Appl. No.: 09/214,727

[22] PCT Filed: Jul. 14, 1997

[86] PCT No.: PCT/US97/12586

§ 371 Date: Jan. 11, 1999

§ 102(e) Date: Jan. 11, 1999

[87] PCT Pub. No.: WO98/02630

PCT Pub. Date: Jan. 22, 1998

Related U.S. Application Data

[63] Continuation-in-part of application No. 08/682,173, Jul. 16, 1996, Pat. No. 5,782,118.

[51] Int. Cl.[7] ..... E05B 47/00

[52] U.S. Cl. ..... 70/279.1; 70/277; 70/283

[58] Field of Search ..... 70/277–279.1, 70/283, 107, 221–224, 218, 467–472; 292/144

[56] References Cited

U.S. PATENT DOCUMENTS

| | | | |
|---|---|---|---|
| 2,018,093 | 10/1935 | Schlage | 70/91 |
| 2,738,666 | 3/1956 | Tornoe | 70/216 |
| 2,998,274 | 8/1961 | Russell | 292/169 |
| 3,894,417 | 7/1975 | Taniyama | 70/156 |
| 3,916,656 | 11/1975 | Schlage | 70/148 |
| 3,955,387 | 5/1976 | Best et al. | 70/224 |
| 4,073,527 | 2/1978 | Schlage | 292/347 |
| 4,583,382 | 4/1986 | Hull | 70/107 |
| 4,604,879 | 8/1986 | Neary et al. | 70/224 |
| 4,920,773 | 5/1990 | Surko, Jr. | 70/224 |
| 4,956,984 | 9/1990 | Chi-Cheng | 70/277 |
| 5,010,752 | 4/1991 | Lin | 70/277 |
| 5,018,375 | 5/1991 | Tully | 70/472 |
| 5,040,391 | 8/1991 | Lin | 70/277 |
| 5,083,122 | 1/1992 | Clark | 340/825.3 |
| 5,421,178 | 6/1995 | Hamel | 70/283 |
| 5,473,236 | 12/1995 | Frolov | 318/286 |
| 5,474,348 | 12/1995 | Palmer et al. | 292/339 |
| 5,628,216 | 5/1997 | Qureshi et al. | 70/279 |
| 5,694,798 | 12/1997 | Nunez et al. | 70/283 |
| 5,782,118 | 7/1998 | Chamberlain et al. | 70/279 |

FOREIGN PATENT DOCUMENTS

| | | |
|---|---|---|
| 0 219 694 | 4/1987 | European Pat. Off. . |
| 0 349 452 | 1/1990 | European Pat. Off. . |
| 0 551 147 | 7/1993 | European Pat. Off. . |
| 9403769 | 4/1994 | Germany . |
| WO84/03909 | 10/1984 | WIPO . |
| WO95/00733 | 1/1995 | WIPO . |

*Primary Examiner*—Suzanne Dino Barrett
*Attorney, Agent, or Firm*—Michael H. Minns, Esq.; Oldham & Oldham Co., LPA

[57] ABSTRACT

A door lock (1), preferably operable both by a mechanical key (C) with a key cylinder (60) and by an electronic signal and having inside and outside handles (A, B) mounted on inside and outside hollow spindles (10, 50), for mounting on a door having an inside face and an outside face, has a cylindrical lock chassis (80) with a provision for retracting a latch bolt (4) in response to rotation of either of the hollow spindles (10, 50); a member (40) for selectively locking the outside spindle (50) against rotation; a reversible electric motor (20) mounted coaxially within the inside spindle (10), the motor being secured against rotation but free to slide axially against resistance provided by a biasing member (21), and having a motor shaft (31) extending through the cylindrical lock chassis (80) to operably engage the member (40) for locking the outside spindle (50); a power supply (101) for the motor (20); and a mechanism (42, 45, 61) for selectively moving the member (40) between locked and unlocked positions.

20 Claims, 12 Drawing Sheets

LOCKSET WITH MOTORIZED SYSTEM FOR LOCKING AND UNLOCKING

This is a national phase application of PCT application PCT/US97/12586, which is a contination-in-part of U.S. application No. 08/682,173, filed Jul. 16, 1996 (now U.S. Pat. No. 5,782,118).

BACKGROUND OF THE INVENTION

This invention relates generally to electronic door locks and more particularly to locks having locking and unlocking functions driven by rotary DC motors in addition to mechanical key override.

Electrically operated door locksets are well known in the door lock industry. Typically they are "hard wired" from the standard AC system of the building through a transformer to operate a solenoid actuator in the lockset. The use of a rotary DC motor in place of a solenoid consumes less power and provides opportunities to employ the lock in battery powered "stand alone" installations. Because of the high power consumption of solenoid actuators, they are not practical for use in such installations.

Generally, in such systems, the locking function is carried out by an axially movable locking lug for simultaneously engaging slots in the outside spindle and the lock mounting hub to prevent turning of the spindle. Rotary DC motors are the preferred actuators for electronic locks; because they draw only low power. However, at stalled condition, such motors may burn out, and the electronics logic may become out of phase with the state of the lock mechanical components after a motor stall. Some presently available electronic locks employ springs between the motor drive and the locking lug to store energy from the motor during a "hang-up" condition. Such a condition may be caused, for example, by leaning on the door lever or knob while operating the lock and is ended when the leaning pressure is released. The energy may be stored between the motor drive coupling and the rotary-to-linear motion converter device, within the rotary-to-linear motion converter device, or between the rotary-to-linear motion converter device and the locking lug. In any case, this energy storage allows the motor to complete its cycle without stalling, thereby remaining in phase with the mechanical components of the lock. When the "hang-up" is released, the spring releases its energy to drive the locking lug to the required locked or unlocked condition.

Since the locking lug is held in the locking position by the spring bias, it follows that anything that can overcome the force of the spring bias, even momentarily, can be used to defeat the lock. Thus, a sharp axial blow to the outside spindle can cause the locking lug to momentarily bounce out of the hub locking slot and momentarily allow the handle to be turned to open the door.

Finally, during assembly of the locksets, the build-up of axial tolerances of components in the spindle may cause a tension or compression pre-load on the spring and thereby disturb timing between the electronic and mechanical parts of the lockset. To assure repeatable trouble free operation of the lock, such tolerance build-up must be compensated for. This requires a degree of adjustability of the components to allow for random variations of part dimensions and to complete assembly of the lock with zero load on the spring. Such adjustments are often very difficult due to limited access to set screws and other adjustment devices in an assembled lockset.

WO 95 007 33A discloses an electromechanical actuator device for causing a control member to move from a rest position to a working position and in an opposite sense to return to the rest position to a working position and in an opposite sense to return to the rest position. WO 84 03 909 discloses a lock device, including an electrically operable lock unit which can be moved between two different locations of extension and which is arranged displace able within a surrounding casing, together with a manually and key operable lock mechanism. DE 94 037 69U discloses a bolt actuating device powered by a direct current motor whose rotation is transformed into longitudinal movement by means of a gear and is transferred by means of a flexible shaft or bent lever.

The foregoing illustrates limitations known to exist in present electronic/mechanical locksets. It would, therefore, be of benefit to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door lock, operable by an electronic signal and having inside and outside handles mounted on inside and outside hollow spindles, for mounting on a door having an inside face and an outside face, the door lock comprising a cylindrical lock chasis having a provision for retracting a latch bolt in response to rotation of either of the hollow spindles; a lock member for locking the outside spindle against rotation; a reversible electric motor mounted coaxially within the inside spindle, the motor being secured against rotation but free to slide axially against resistance provided by a biasing member, and having a motor shaft extending through the cylindrical lock chassis to operably engage the lock member for locking the outside spindle; a power supply for the motor; and a mechanism for moving the lock member between unlocked and locked positions.

These and other aspects will become apparent from the following detailed description of the invention when considered in conjunction with the accompanying drawings.

DETAILED DESCRIPTION

Figure 1:
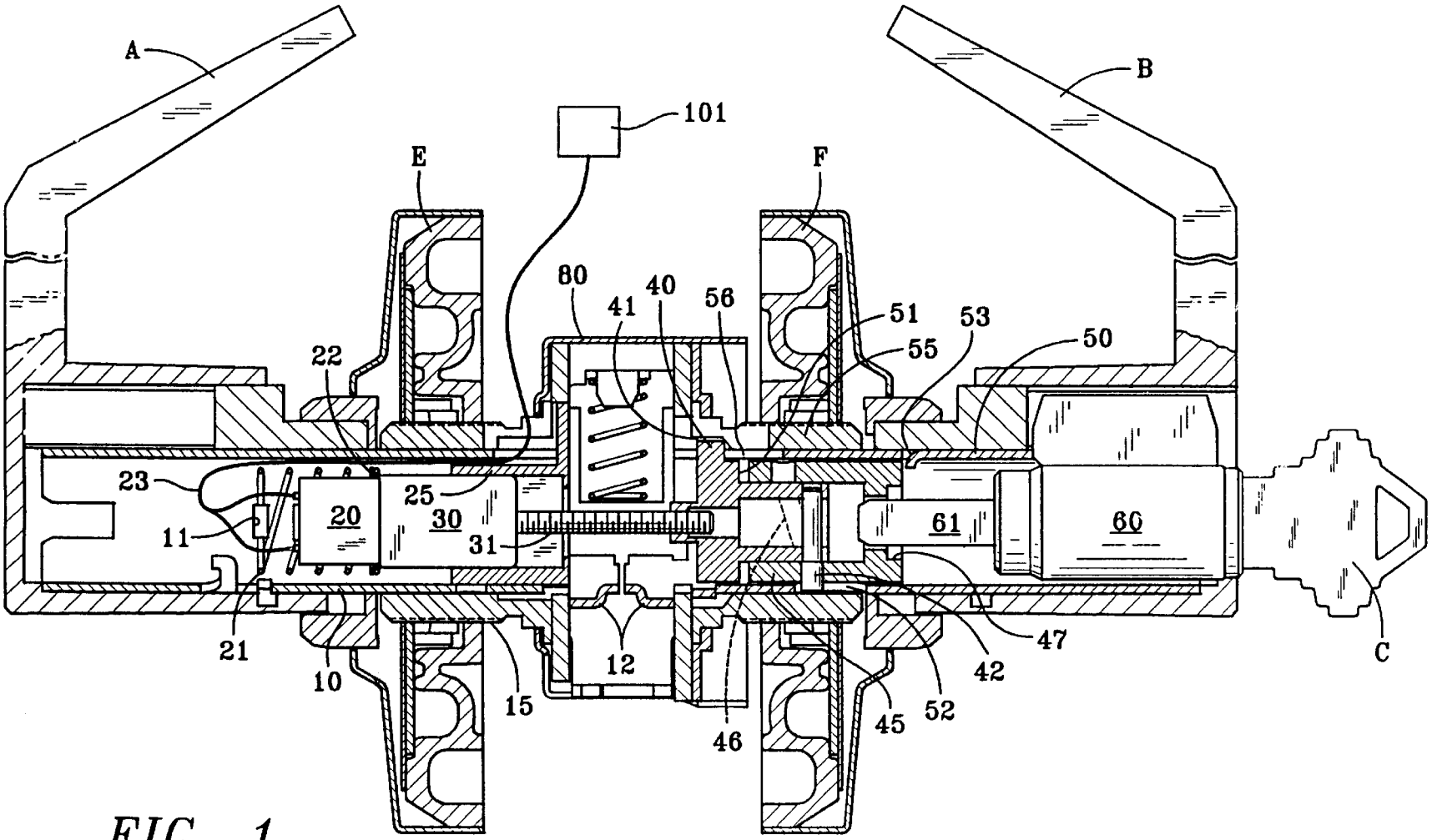
FIG. 1 is a longitudinal cross-sectional schematic plan view with the locking lug and locking slots rotated into the horizontal plane to illustrate the most important features of the motorized lockset of the invention.

FIG. 1 shows an electromechanical lockset embodying the general structure of the invention incorporated in a cylindrical lock. The structure and operation of cylindrical locks is well known and is described in some detail in U.S. Pat. No. 2,018,093 to Walter R. Schlage, U.S. Pat. No. 3,916,656 to Ernest Schlage, and U.S. Pat. No. 4,604,879 to Ralph Neary, et al., which are incorporated herein by reference. Inside lever A and outside lever B are attached to inside spindle 10 and outside spindle 50, respectively. Either lever may be turned to operate its spindle, each of which has at least one roll-back cam 12 at its inboard end for operating a latch retracting cam, not shown, within the cylindrical lock housing 80. Inside hub 15 and outside hub 55 are fixed to the cylindrical lock housing 80 and provide journal support to inside 10 and outside 50 spindles which project outwardly through the hubs. The hubs 15, 55 are externally threaded to permit attachment of inner mounting plate E and outer mounting plate F to the lock housing 80 for mounting in a door.

Figure 3:
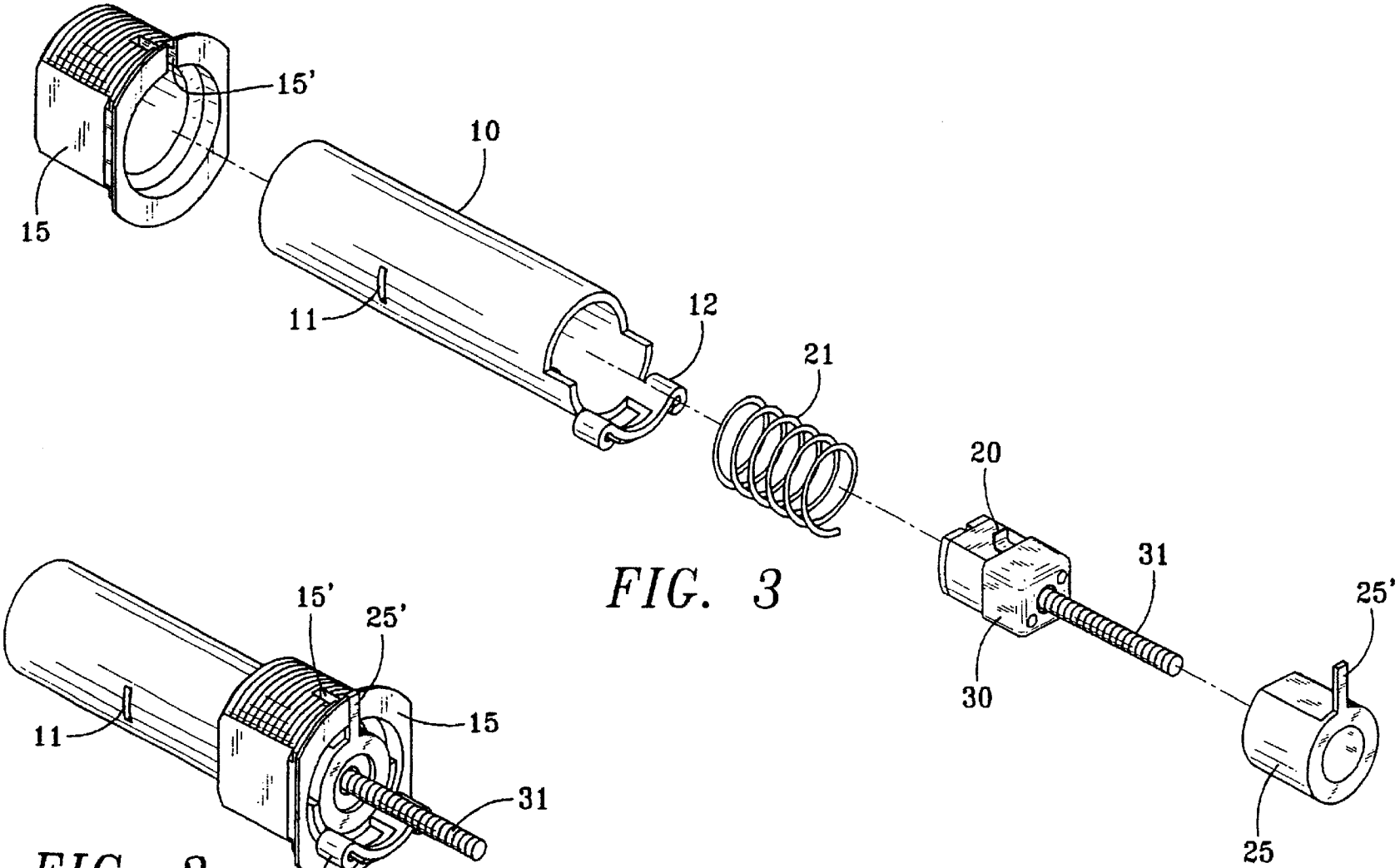
FIG. 3 is a perspective exploded schematic view of the spindle/hub/motor assembly of FIG. 2.
Figure 2:
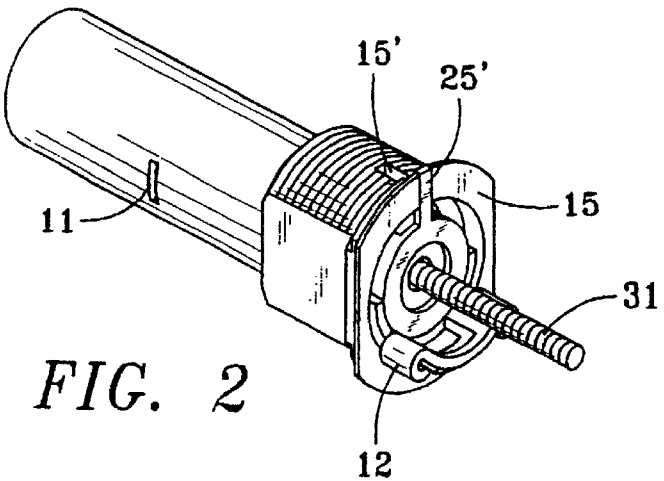
FIG. 2 is a perspective schematic view of an inside spindle/hub/motor assembly.
Figure 2A:
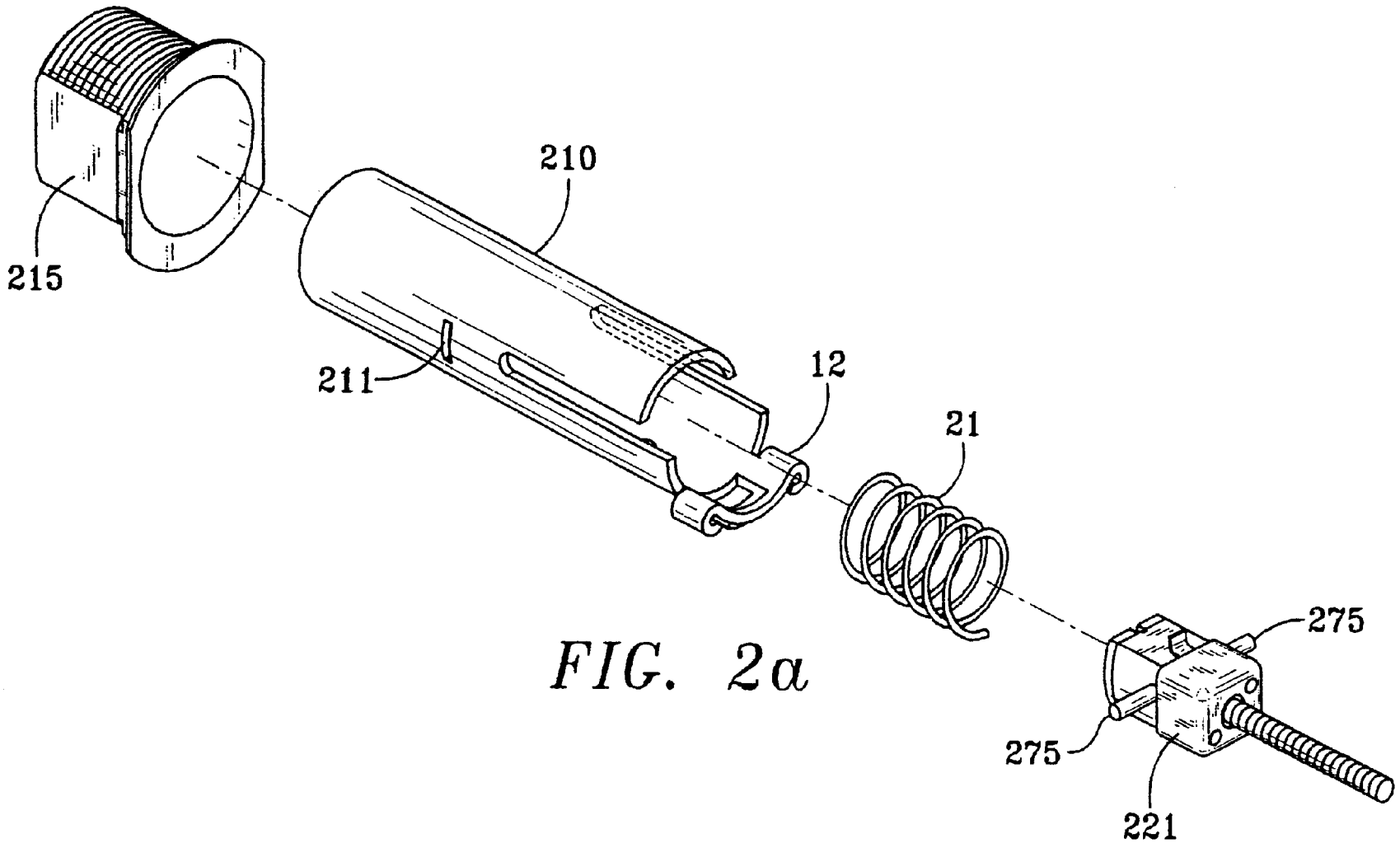
FIG. 2*a* is a perspective exploded schematic view showing an alternative motor mounting arrangement.

Referring to FIGS. 1 to 3, sleeve 25, having a cylindrical outer surface and an inner surface which substantially forms a rectangular parallelepiped is journaled within the inboard end of inside spindle 10. Inside spindle 10 has a portion of its wall cut away over approximately half of its circumference at its inboard end, which may slightly exceed the length of the slot 15' in hub 15. A lug 25' protrudes radially outwardly from the inboard end of the sleeve 25 and nests in slot 15' in inside hub 15 to prevent rotation of the sleeve 25 with respect to hub 15. A DC electric motor 20 has a flexible cord 23 connecting it to a power supply 101, is axially disposed within spindle 10, and has a gear box 30 from which an output shaft 31 extends through the cylindrical lock housing 80. Gear box 30 has a rectangular cross-section and a sliding fit within sleeve 25 so that the assembly of motor 20, gear box 30, and output shaft 31 is free to slide axially and rotate with respect to the inside spindle 10 but is free only to slide with respect to the sleeve 25 and the hub 15. This same rotary restraint together with axial sliding freedom within the spindle 10 can be provided, as in FIG. 2*a*, by axial slots 211 in the wall of inside spindle 210 and lugs 275 protruding from the motor 221 into the slots 211, so the motor 221 is free to slide but not to rotate with respect to the spindle 210. Since the sleeve and lug 25 and 25' of the first embodiment is not used, hub 215, with no slot may be used. In either embodiment, the motor is axially biased to resist axial motion, either toward or away from the cylindrical lock housing 80, by a spring 21 which is attached, at the inboard end, to motor 20 by spring retainers 22 on motor 20 and, at the outboard end, to inside spindle 10 by diametrically opposed spring clamp slots 11 in the wall of the inside spindle 10. Other embodiments of the motor biasing means are possible, and some of those will be described below.

The axially free radially restrained motor mounting scheme prevents the motor 20 from reaching a stalled condition during its programmed running cycle, whether locking or unlocking the lockset. Thus, the motor 20 turns the output shaft 31 for as many turns as required to lock or unlock the lockset, as the case may be. If a "hang-up" condition exists, such as could be caused by a person leaning on the door lever, the motor 20 will complete its full run cycle without stalling; because the rotary work done by the motor 20 will be stored as energy in the spring 21, which, upon release of the hang-up, will convert to equivalent axial motion of the motor 20, the gear box 30, the output shaft 31, and the locking lug 41.

Figure 4:
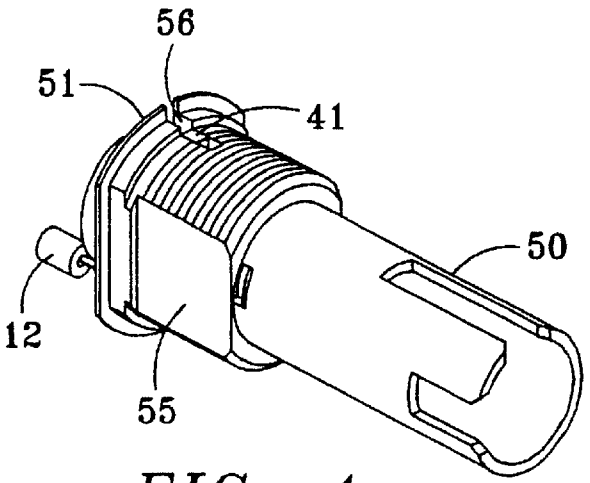
FIG. 4 is a perspective schematic view of an outside spindle/hub/spiral cam/locking lug assembly with the locking lug in the locked position.
Figure 5:
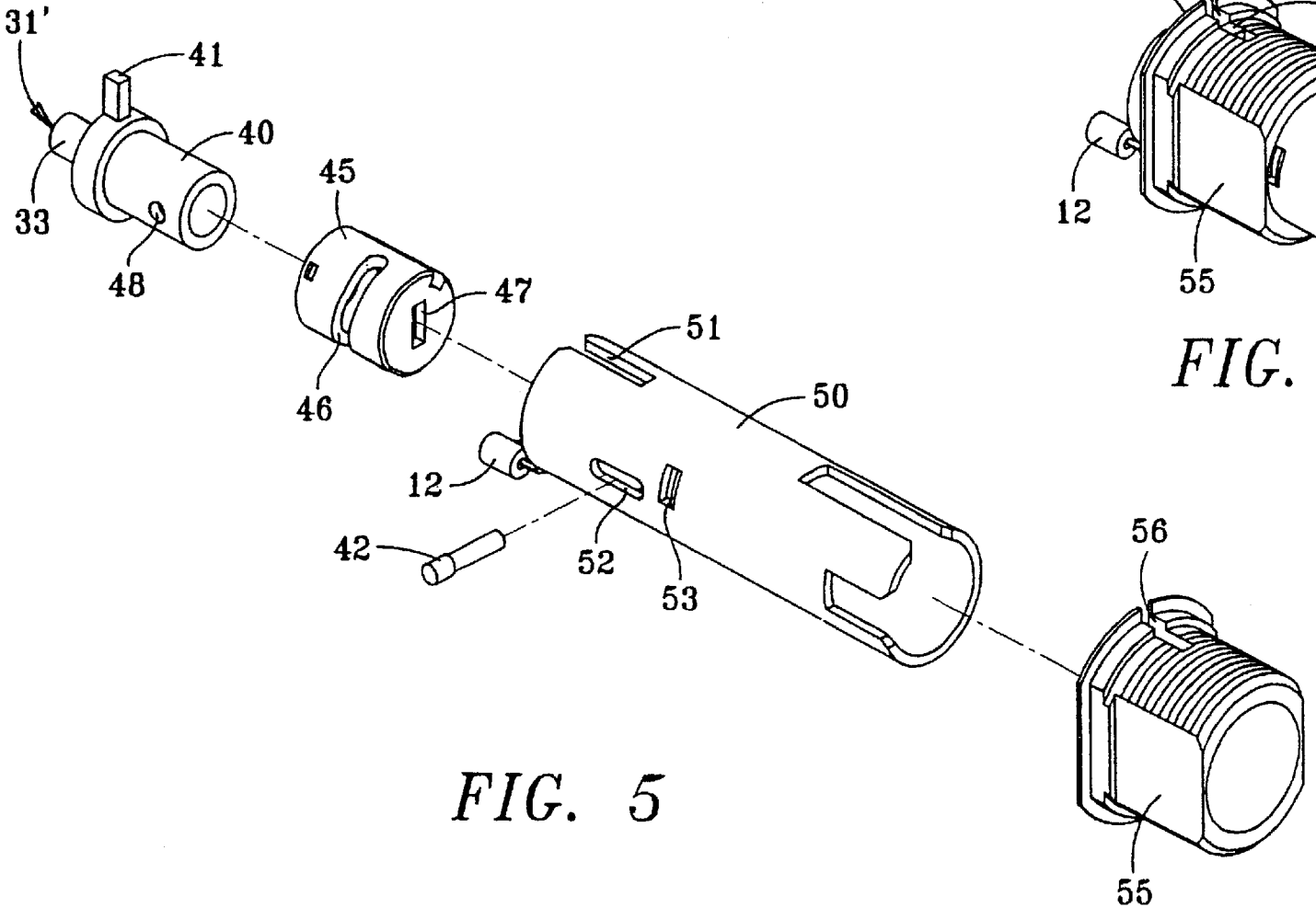
FIG. 5 is an exploded perspective schematic view of the assembly of FIG. 4.

Locking is illustrated in FIGS. 1,4, and 5 and is achieved by preventing rotation of the outside spindle 50 to prevent motion of the roll-back cam 12 and the consequent motion of the latch retracting cam in the cylindrical lock housing 80. As seen in FIG. 4, in the assembled state, outside spindle 50 has an axial locking slot 51 which extends in the inboard direction beyond hub locking slot 56 of outside hub 55. Spindle locking slot 51 aligns with hub locking slot 56 when the handle B is in its parked position. A cylindrical cam plug 40, as in FIG. 5, with a locking lug 41 protruding radially outwardly at an inboard end is disposed within a spiral cam 45. The spiral cam 45 is mounted within outside spindle 50, inboard of and abutting a cam stop 53 protruding radially inwardly from the wall of spindle 50, and is connected thereto by a cross pin 42 which protrudes through a pin slot 52 in the spindle wall through a spiral aperture 46 in spiral cam 45 and into transverse holes 48 of the cam plug 40. When the spiral cam 45 is rotated, the cam plug 40 is driven axially by the interaction of the cross pin 42 and the spiral aperture 46 of the spiral cam 45. Cross pin 42 is free to slide axially in the pin slot 52 of outside spindle 50 and to accommodate the motion of cam plug 40 caused by the cross pin 42 occupying the pin slot 52, the spiral slot 46, and the transverse holes 48, simultaneously, of the outside spindle 50, the spiral cam 45, and the cam plug 40, respectively. When the spiral cam 45 is turned clockwise, as viewed in FIG. 5, the spiral aperture 46 causes cross pin 42 to move toward the inboard end of pin slot 52 of outside spindle 50, and, because the pin also is in the transverse holes 48 of cam plug 40, it also drives the cam plug 40 toward the inboard end of the spindle 50. This results in the locking lug 41 disengaging from hub locking slot 56 and the outside handle B being freed for rotation. Note that, if the spiral cam 45 is turned by the tailpiece 61 of the key cylinder 60 using the key C, this action does not rotate the motor 20 or its output shaft 31. It merely pushes the motor toward the outboard end of inside spindle 10 and compresses spring 21. Conversely, when the key C is rotated counterclockwise, the spiral cam 45 produces the opposite result and locks the outside spindle 50 to the outside hub 55, at the same time relaxing spring 21. The motion of locking lug 41 is the same whether it is driven by the rotation of the spiral cam 45 or by the operation of the electric motor 20.

Cam plug 40 has a hub 33 which has an internally threaded hole 31' for engaging the threads on the output shaft 31 of the motor 20. When the motor 20 turns the shaft 31, the cam plug 40 together with the spiral cam 45 and the cross pin 42 is either pushed toward its locking position in the hub locking slot 56 or pulled toward the motor 20 and gear box 30. When pulled toward the motor, the locking lug 41 is disengaged from the outside hub locking slot 56 but still engaged in the spindle locking slot 51. This is due to the spindle locking slot 51 extending beyond the outside hub locking slot 56. When pushed toward the outboard end of spindle 50, the locking lug 41 protrudes radially through slots 51 and 56 of outside spindle 50 and hub 55, respectively, thus preventing relative rotation.

If the key C is turned in key cylinder 60, it causes the tailpiece 61, which extends from the key cylinder 60 into the spiral cam 45 through the aperture 47 to turn. The shape of aperture 47 in FIG. 5 is suited for direct drive, although other shapes are possible which will allow, for example, for various amounts of lost motion. The exact shape of aperture 47 is not critical and will not be further discussed.

Figure 6:
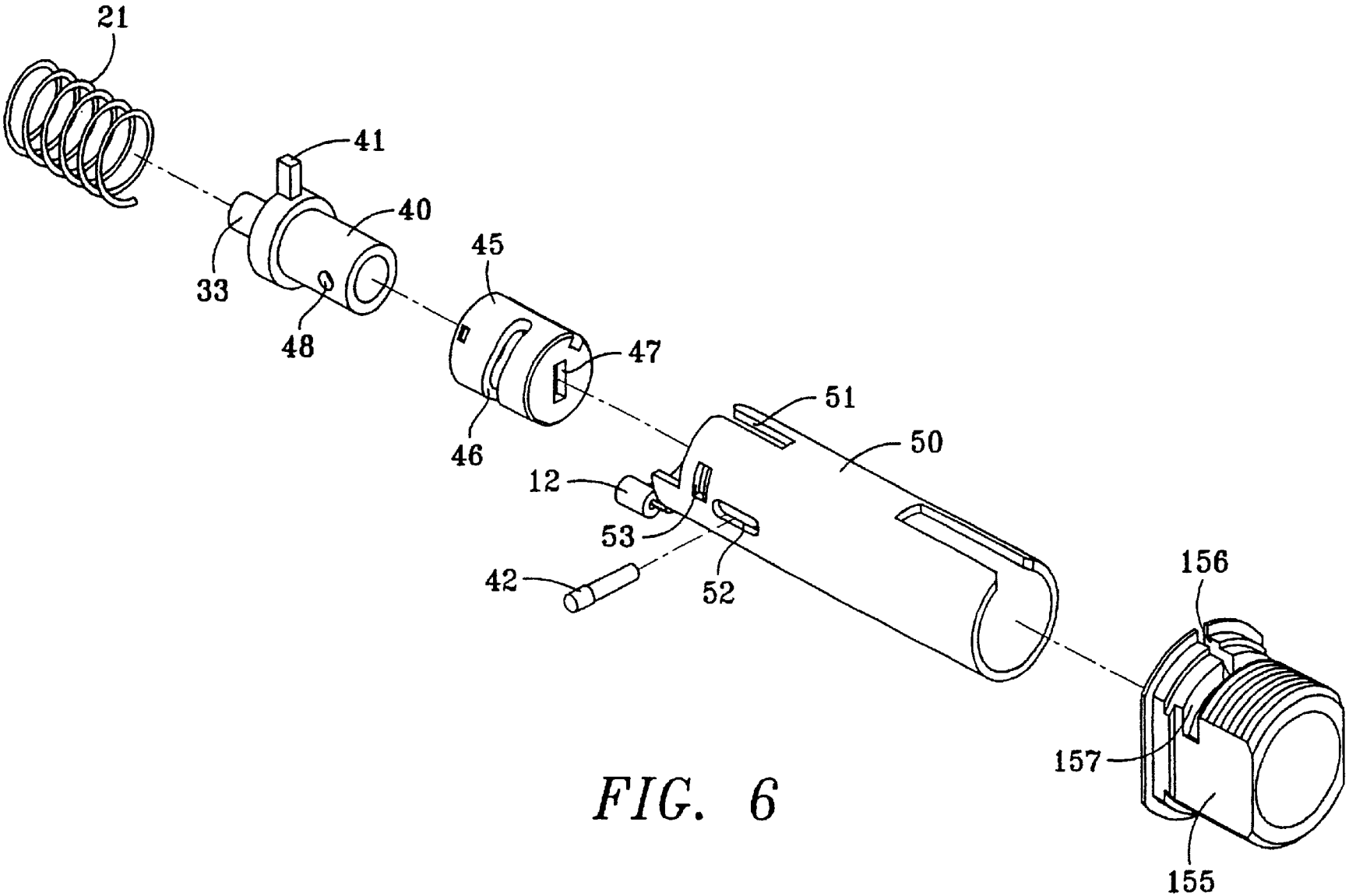
FIG. 6 is an exploded perspective view showing a modification to the outside hub and spindle to maintain the locked condition when subjected to impacts.

The locking arrangement in FIG. 6 is different from that already described in that the outside hub 155 is designed in reverse of that of the previous embodiment. The hub locking slot 156 is the same, but there is a circumferential slot 157 subtending about 140° of arc of the hub 155 and intersecting the hub locking slot 156. In the locked condition, the locking lug 41 is positioned in hub locking slot 156, while, in the unlocked state, the locking lug 41 is positioned in circumferential slot 157, outboard of the locking slot 156. This arrangement prevents defeat of the lock by axial impacts on the outside handle B to cause the spring biased locking lug 41 to bounce out of the locking slot as can be done to the lock of the previous embodiment. This is possible because of the spring bias which is required to avoid motor burn-out under hang-up conditions. Since the locking lug 41 is held in the hub locking slot only by the spring bias in the previous embodiment, the impulse of the impact transfers through the spindle to the locking lug, causing the lug to bounce against the bias of the spring and to disengage from the locking slot.

Figure 7B:
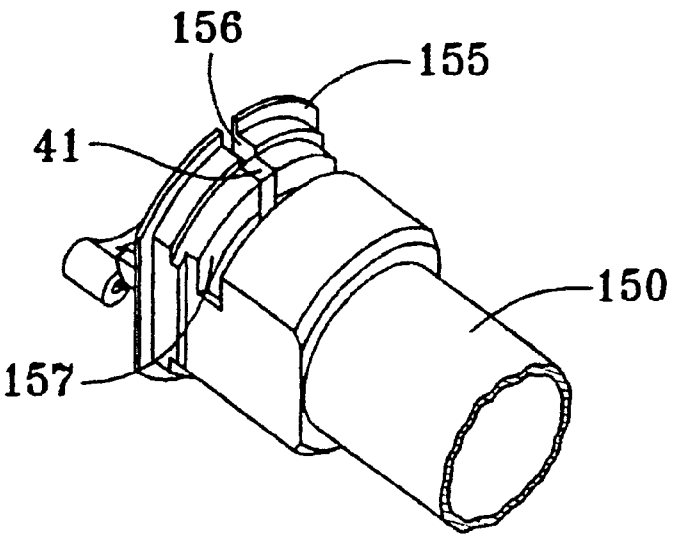
FIGS. 7*a* and 7*b* show the locking lug of FIG. 6 in unlocked and locked conditions, respectively.
Figure 7A:
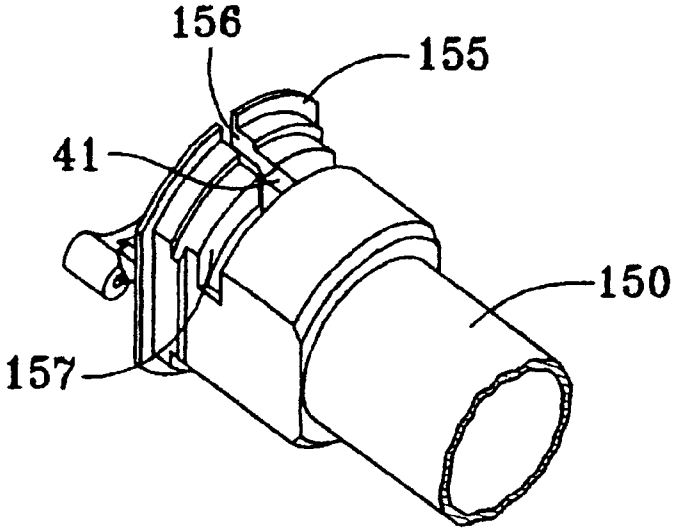

With the inwardly moving locking action in this embodiment, the inward impulse of the locking lug 41 is dissipated by contact of the spiral cam 45 with cam stop 153 in outer spindle 150, so the locking lug 41 remains engaged in the locking slot 156. Of course, locking and unlocking motions are in opposite directions from those of the previous embodiment with the locking lug moving toward the outboard end of the spindle to unlock the spindle from the hub and toward the inboard end to lock the spindle to the hub. FIGS. 7*a* and 7*b* show the unlocked and locked states, respectively.

Figure 8:
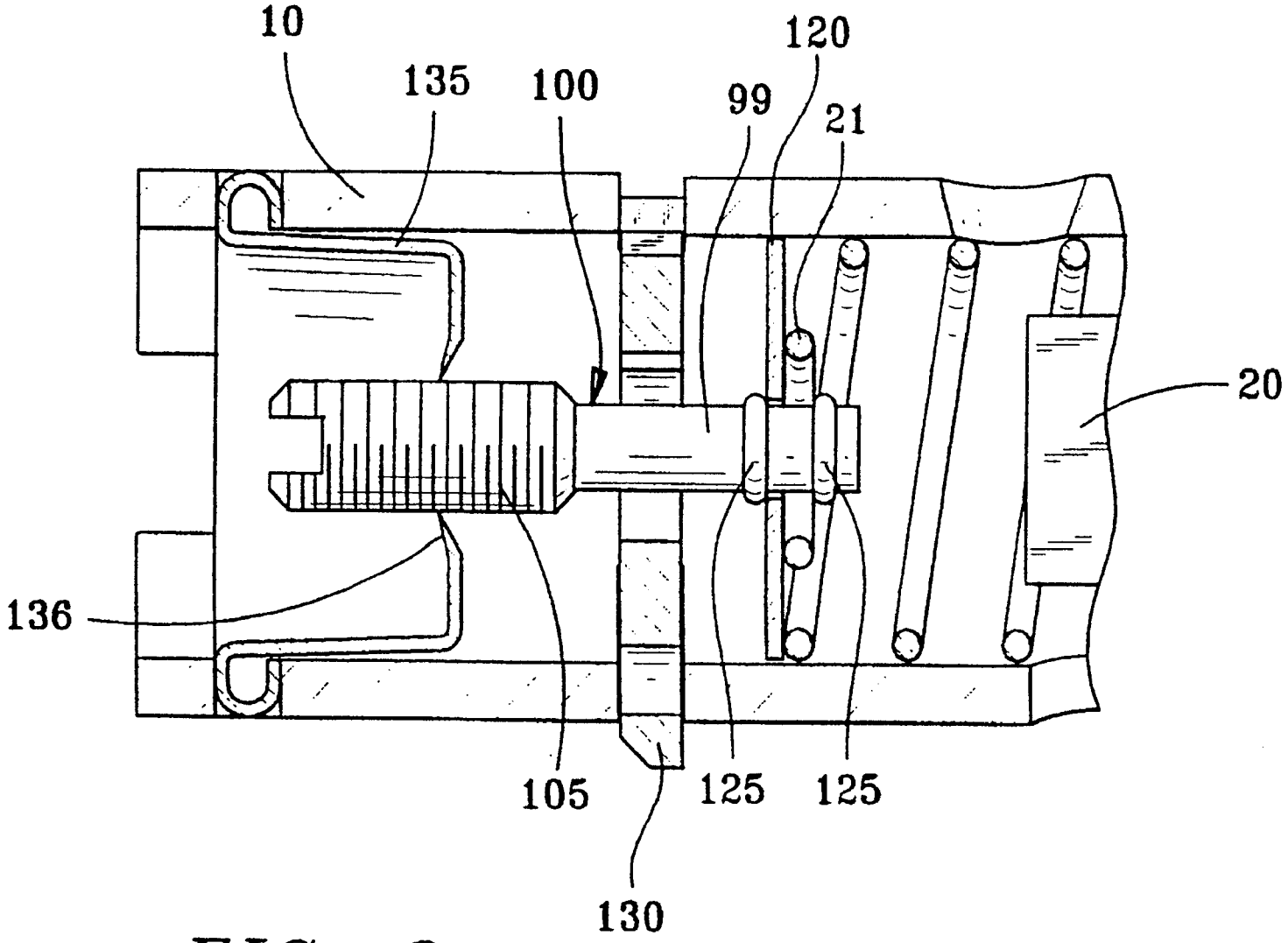
FIG. 8 is a fragmentary schematic cross-sectional plan view of an adjustable biasing arrangement for mounting the motor within the spindle.
Figure 9:
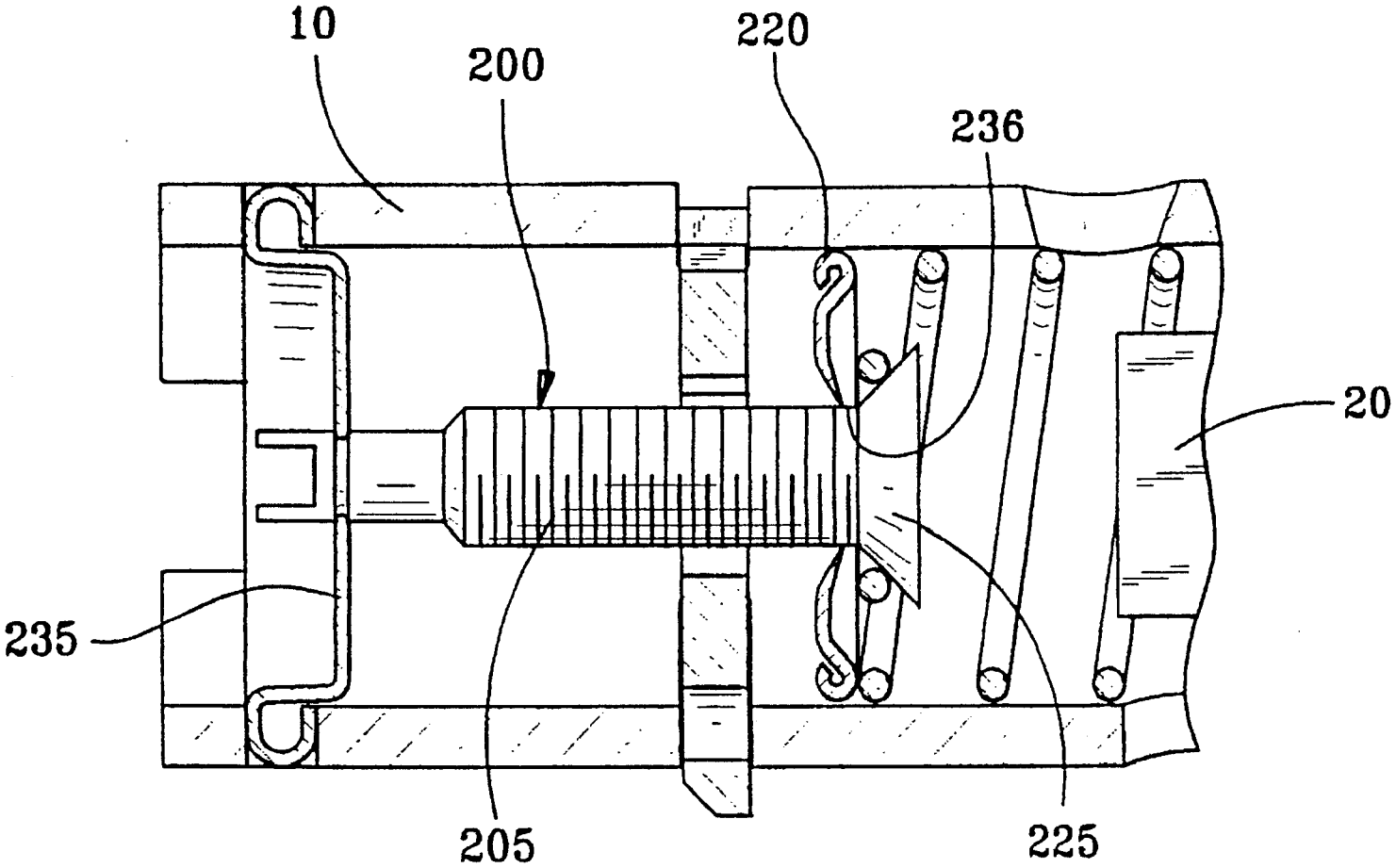
FIG. 9 is a fragmentary schematic cross-sectional plan view of an alternative adjustable biasing arrangement.

FIG. 8 shows the features of the bias spring adjustment mechanism in the inside spindle 10 which is included to compensate for tolerance build-up of the components of the lockset. Spring 21 is attached at its inboard end to the motor 20, as earlier described, by retainer tabs 22. In this embodiment, the outboard end of the spring 21 does not have any ears for attachment to the spindle. Instead, the spring 21 is attached to a spring clamping plate 120, which has a centered hole through which a reduced diameter portion of the unthreaded end 99 of a threaded stud 100 projects. The stud 100 is rotatably held in plate 120 by clips 125 which engage grooves on the stud end 99. Outboard of the plate 120 and spring 21 is a flat substantially rectangular knob catch 130 which also has a centered circular clearance hole through which the unthreaded portion 99 of stud 100 protrudes. Fixed at the outboard end of inside spindle 10 is a cup-shaped anchor 135 with a thread 136 formed at the center of its inboard end. Of course any female threaded connector can be used, such as a molded polymeric unit, or sheet metal fastener. The threaded portion 105 of the stud 100 is engaged in the thread 136 of anchor 135, and through its connection to plate 120, provides a mechanism for adjusting the position of the spring 21 to whatever location is required for proper operation of the lockset. By this means, the stud 100 can be used to adjust the axial position of the motor 20, the gearbox 30, the output shaft 31, and the cam plug 40 relative to the locking slot 56 in hub 55. This assures that the lock will operate with proper timing between the electric motor 20 and the mechanical key cylinder 60. The same adjustability can be accomplished, as in FIG. 9, by rotatably attaching the stud 200 to a flat anchor 235 and having its threaded portion 205 engaging a threaded hole 236 in the clamping plate 220. A headed portion 225 of the stud 200 prevents the stud from being completely unthreaded from the clamping plate 220.

Figure 10A:
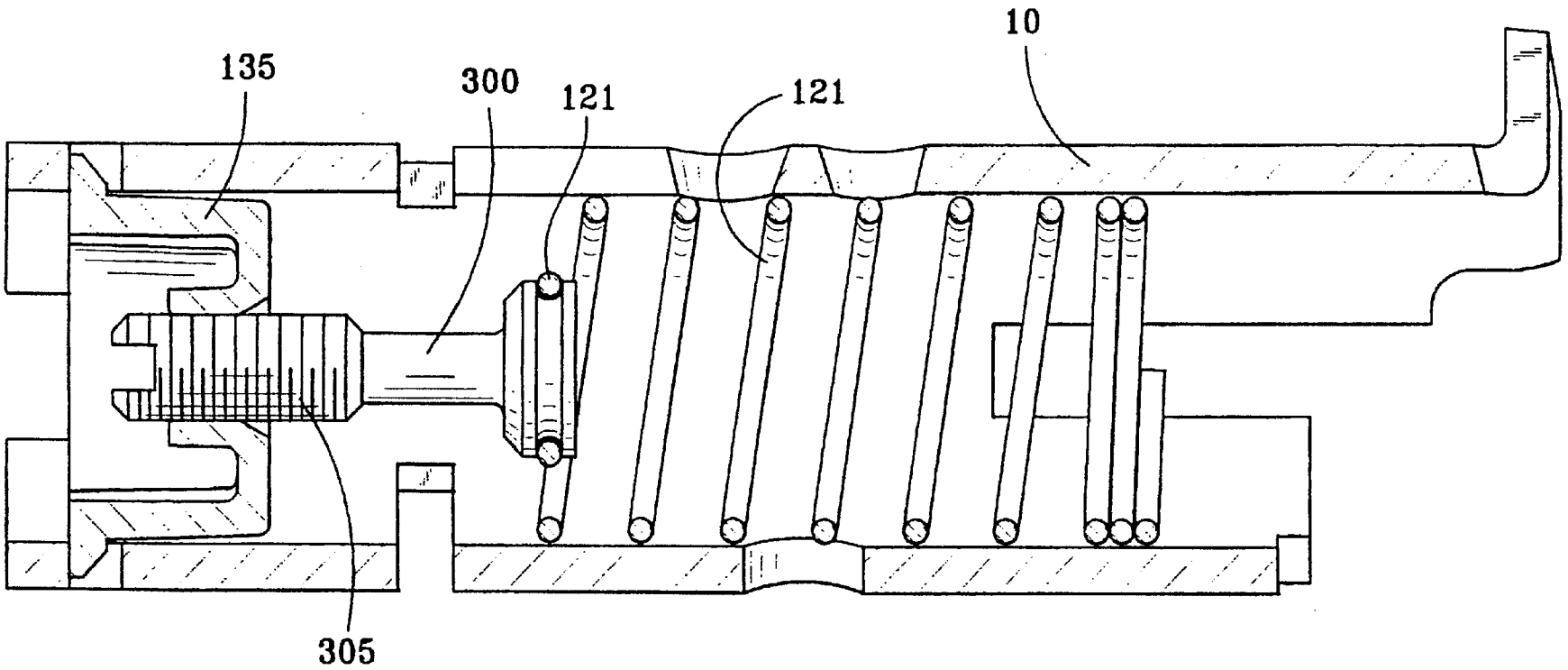
FIGS. 10*a* and 10*b* show a plan view and a perspective view, respectively, of another alternative arrangement for bias adjustment.
Figure 10B:
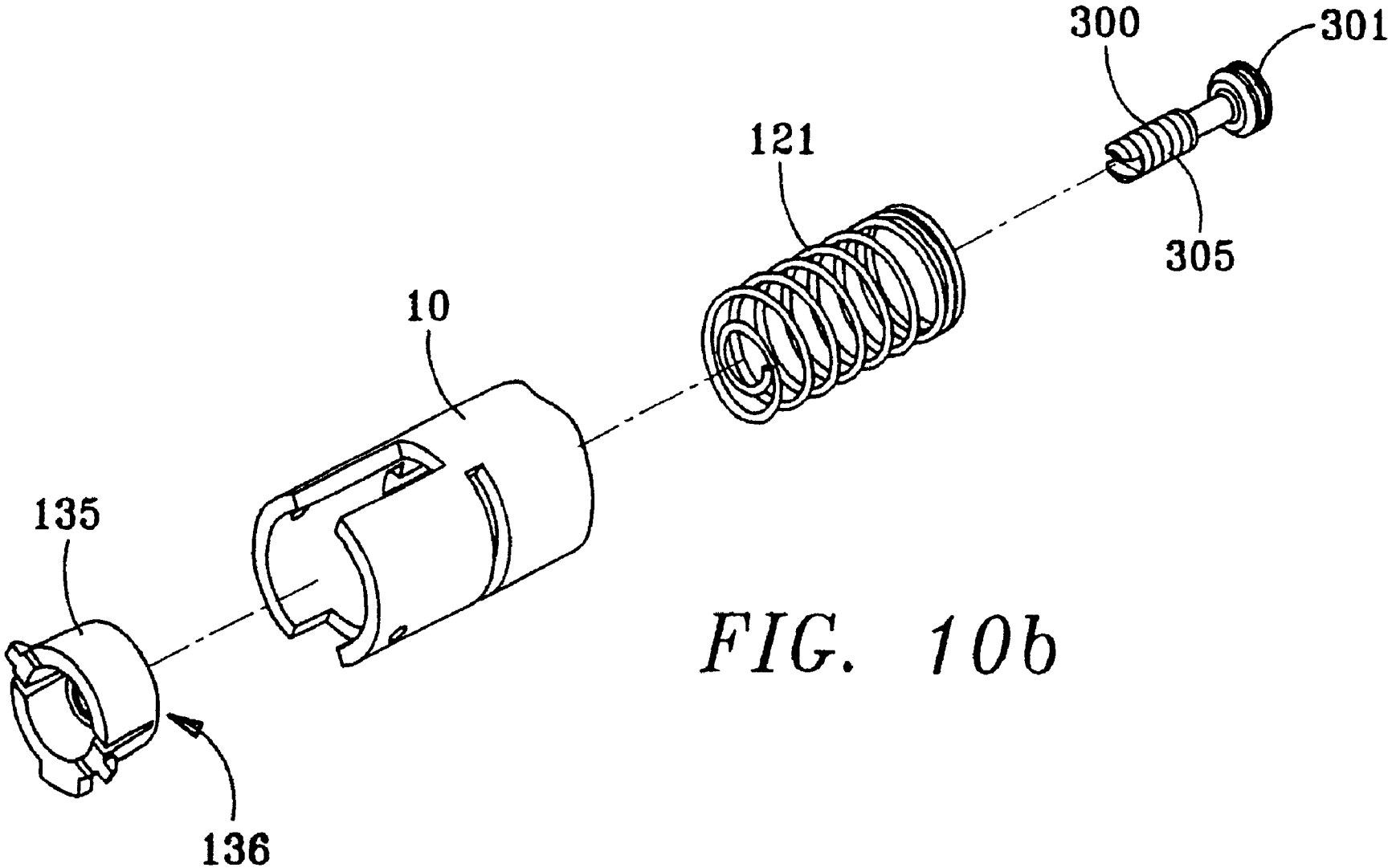

FIGS. 10*a* and 10*b* illustrate yet another embodiment with similar adjustment operation. Plate 120 and clips 125 are eliminated and the stud 300 is engaged with the spring 121 by means of the last outboard coil having a diameter small enough to snap into and grip a groove 301 near the inboard end of stud 300. The spring 121 thereby grips the stud 300, which is free to turn so it may move axially inward and outward in response to the action of the threaded portion 305 with the thread 136 of anchor 135 as previously described.

Figure 11:
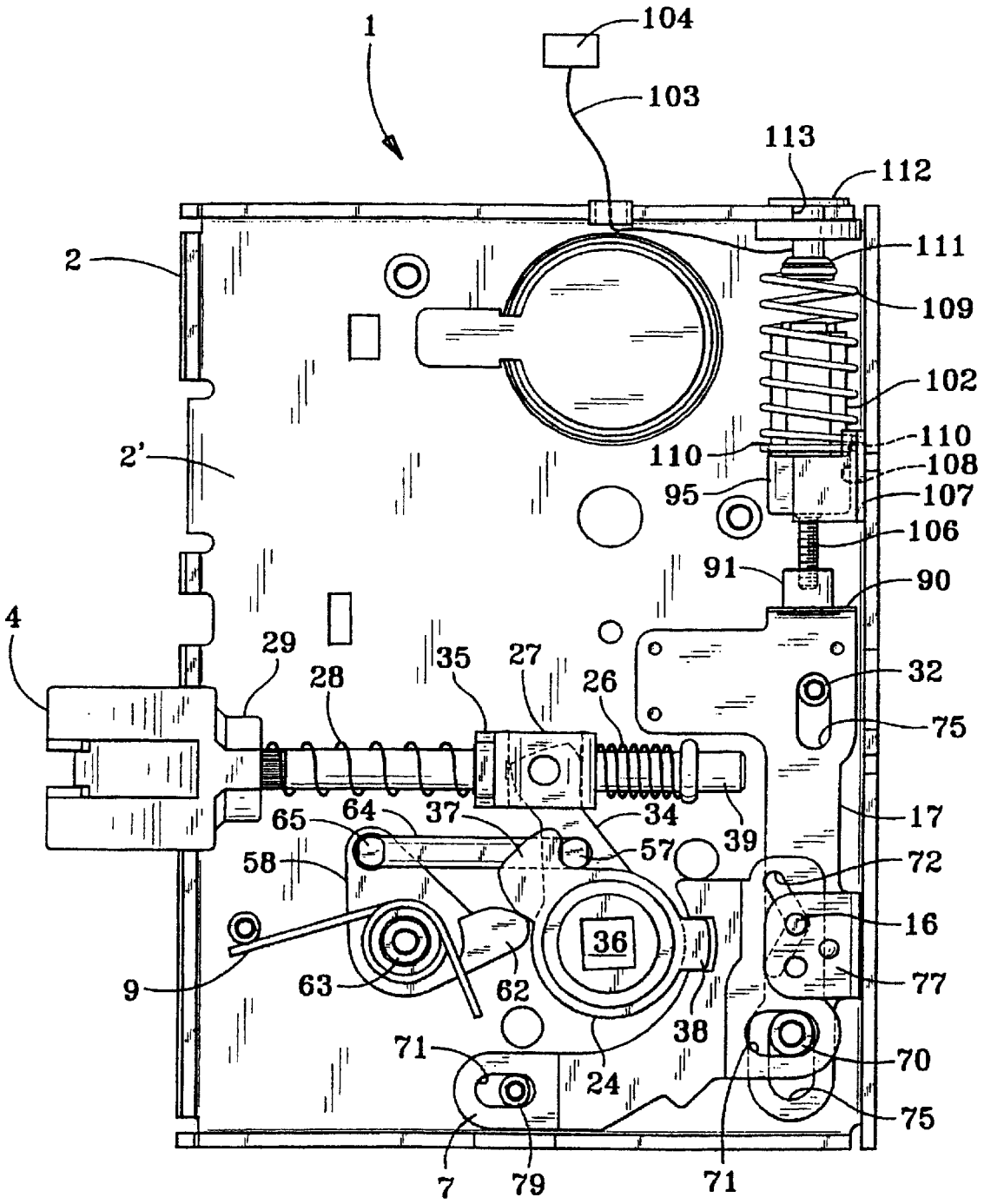
FIGS. 11 and 12 show a plan view of an alternate embodiment of the motor arrangement for use with a mortise lock.

FIG. 11 shows an alternate embodiment of the axially free, rotationally restrained motor for use in a mortise lockset 1. A typical mortise lockset is described in U.S. Pat. No. 4,583,382, which is hereby incorporated by reference. FIG. 11 includes only the parts of the mortise lockset necessary to illustrate the electrical locking and unlocking of the retractor hub 24 and the latch bolt 4.

Shown in FIG. 11 are the retractor hubs 24 which are operated by the lock handles (not shown) and permit under certain conditions the retraction of the latch bolt 4. The lock is provided with a stop works catch 7 which selectively secures one retractor hub 24 section from rotation. A latch bolt operator 34 operates in response to rotation of the retractor hub 24. The latch bolt operator 34 contacts saddle 27 of the latch bolt 4 and provides the direct contact means for retracting the latch bolt. Saddle 27 is slidably mounted on the latch bar 39 and resiliently positioned by release spring 26. Latch bar extension spring 28 serves to extend latch bolt 4 by interaction between the latch bolt hub 29 and saddle/latch bolt guide 35.

Figure 12:
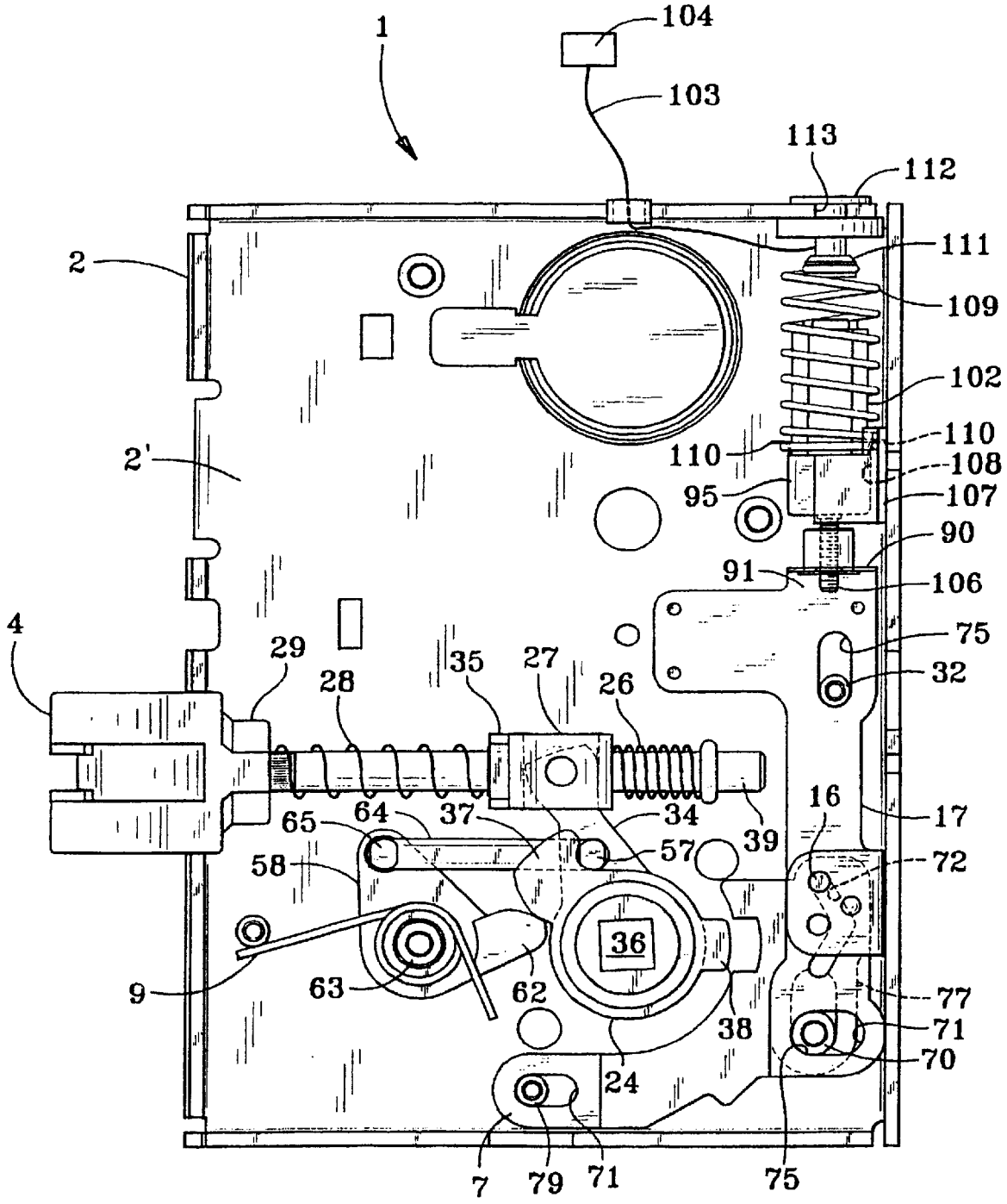

Retractor hub 24 is rotatably mounted in the lock case 2 and is operated by means of the lock handles through square drive 36. Retractor hub 24 is comprised of two identical overlaid sections each having a gear tooth like operating tooth 37 and a stop works engaging projection 38. The mounting of the two identical hub sections permits either section to rotate clockwise or counterclockwise independent of each other. One section lies to the inside of the lock case. The other lies to the outside of the lock case. In FIGS. 11 and 12, only the retractor hub section towards the viewer may be seen. It should be appreciated that rotation of one of the retractor hubs will not rotate the other hub. However, since both hubs provide the same function, it should be understood that rotation of the inside hub section may operate the latch bolt while the outside hub section is locked from outside rotation by the stop works.

Referring now to FIGS. 11 and 12, clockwise rotation of the retractor hub 24 will cause operating tooth 37 to engage the latch bolt operator 34. This will in turn cause the latch bolt operator 34 to rotate about the center of the retractor hub 24 and thereby through contact with the latch bolt saddle 27 cause the latch bolt 4 to be displaced to the right.

Counterclockwise rotation of the retractor hub 24 causes the operating tooth 37 to contact bell crank 58 at its full depth tooth-like projection 62. The contact rotates bell crank 58 about pivot 63 in a clockwise direction thereby displacing reverse retractor link 64 to the right. Reverse retractor link 64 is pivotally connected to the bell crank 58 at pivot point 65 on its one end and latch bolt operator 34 on its other end 57. Retractor spring 9 resists the clockwise rotation of the bell crank 58 and restores the retractor hubs 24 to the neutral position when the lock handles are released.

FIG. 11 shows the stop works engaged with the retractor hub 24, thereby preventing it from rotating. This position locks the outside handle and prevents retraction of the latch bolt 4 from the outside of the lock. FIG. 12 shows the stop works disengaged from the retractor hub 24, thereby allowing the retractor hub 24 to rotate.

The stop works catch 7 is slidably mounted on pins 70 and 79 which cooperate with the elongated holes 71 in the stop works catch 7 to permit horizontal displacement of the stop works catch 7 from the lock to the unlocked position. Stop works cam slot 72 provides the drive to displace the stop works catch 7 from the locked to the unlocked position. The stop works function is accomplished by action on an operating slide plate 17. Stop works link plate 17 is mounted for linear translation in the vertical direction as shown in FIGS. 11 and 12. Guide pin 32 near the top of the stop works link plate 17 and guide pin 70 located near the bottom of the stop works link plate 17 cooperate with elongated slots 75 in the stop works link plate 17 to permit the translation movement. The stop works link plate 17 is provided with a first folded-over bracket 77 which supports stop works cam pin 16. The stop works cam pin 16 cooperates with a V-shaped stop works cam 72 in stop works catch 7 in such a manner that displacement of the stop works link plate 17 vertically upward cams the stop works catch 7 to the right or unlocked position as shown in FIG. 12.

The stop works link plate 17 is provided with a second folded-over bracket 90 which rigidly supports threaded bushing 91. The axis of the thread in bushing 91 is parallel to the axis of the elongated slots 75 in stop works link plate 17.

A rotary electric motor 102 (preferably DC) having a flexible cord 103 connecting the motor 102 to an external power supply 104 is disposed within case 2, and has a gearbox 95 of rectangular cross-section from which a threaded output shaft 106 extends and couples with the threaded bushing 91 in stop works link plate 17. Around gearbox 95 is disposed guide 107 which contains a rectangular cavity 108 matching the rectangular cross-section of gearbox 95. The thickness of guide 107 is such that in its installed position between the wall of case 2 and the cover 2', it prevents rotation but allows sliding axial motion of the gearbox 95 when the electric motor 102 is operation. As an alternative, the motor 102 can have a rectangular cross-section which cooperates with the rectangular cavity 108. The guide 107 also serves to maintain axial alignment between the motor output shaft 106 and the threaded bushing 91 in stop works link plate 17.

The motor 102 with its gearbox 95 is axially biased, to resist motion either toward or away from the threaded bushing 91 in stop works link plate 17, by a spring 109 which is attached at one end to the gearbox 95 by spring retainers 110 integral with the cover of gearbox 95, and at the other end to a rotatable externally threaded stud 111, and subsequently to an internally threaded anchor 112 which is retained in a slot 113 in the top wall of case 2.

The function of the threaded stud 111 engaging in threaded anchor 112 is to provide axial adjustment for the position and tension or compression of the spring 109 and the attached motor 102 with gearbox 95 and output shaft 106 for the proper functioning of the stop works link plate 17 in the lockset.

Considering the stop works catch 7 in an initially locked state, as shown in FIG. 11, then when the output shaft 106 rotates in such a direction that the coupled threaded bushing 91 is raised, the rigidly attached stop works link plate 17 is also raised. The previously described action of cam pin 16 in V-shaped cam slot 72 causes the stop works catch 7 to disengage the projection 38 on retractor hub 24 and unlock the retractor hub 24 (as shown in FIG. 12). Contrariwise, when the output shaft 106 rotates in the opposite direction, the coupled threaded bushing 91 and attached stop works link plate 17 are lowered and the action of cam pin 16 in V-shaped cam slot 72 causes the stop works catch 7 to engage the projection 38 on hub 24 and lock the hub.

The motor 102 turns the gearbox output shaft 106 for as many turns as required to lock or unlock the stop works. If a "hang-up" condition exists, such as could be caused by a person attempting to rotate the operating lock handle (not shown) before the stop works is fully unlocked, the axially biased motor and gearbox mounting scheme prevents the motor 102 from reaching a stalled condition during its operational running cycle, whether locking or unlocking the stop works. The motor 102 will complete its operational rotations without stalling, but since the stop works mechanism is prevented from moving by the "hang-up" condition, the rotational work done by the motor will be stored as energy in the spring 109, which, upon release of the "hang-up", will convert to equivalent linear motions of the stop works mechanism.

We claim:

1. A door lock, operable by an electronic signal and having inside and outside handles (A, B) mounted on inside and outside operators respectively and having a locking means for moving a latch bolt (4) from an extended position to a retracted position, the locking means being engaged with the operators, the inside and outside operators being rotatable from a first position wherein the latch bolt (4) is in an extended position to a second position wherein the latch bolt (4) is in a retracted position, the door lock comprising:

a housing (80);

means for preventing rotation of the outside operator; and a reversible electric motor (20, 102) mounted within the housing (80), the motor (20, 102) being secured against rotation but free to slide axially against resistance provided by a biasing means (21, 109) and having a motor shaft (31, 106) extending therefrom to operably engage the means for preventing rotation, the motor (20, 102) moving the means for preventing rotation between an unlocked position wherein the outside operator is free to rotate and a locked position wherein the outside operator is locked against rotation.

2. The door lock according to claim 1, wherein the operators are hollow spindles (10, 50).

3. The door lock according to claim 2, wherein the motor (20) is mounted co-axially within the inside operator.

4. The door lock according to claim 1, wherein the operators are retractor hubs (24).

5. The door lock according to claim 4, wherein the motor (102) is mounted such that a longitudinally extending axis of the motor is transverse to the axis of the operators.

6. The door lock according to claim 2, wherein the means for preventing rotation of the outside operator comprises a locking lug (41) which protrudes outwardly through an axial slot (51) in the outer spindle (50) and which is axially movable into engagement with an axial slot (56) in a fixed lock-mounting hub (55).

7. The door lock according to claim 6, further comprising:

a cam plug (40) having the locking lug (41) projecting radially outwardly from a peripheral surface thereof, the cam plug (40) having means for being moved axially by the electric motor (20) when the motor (20) is actuated.

8. The door lock according to claim 7, wherein the means for being moved axially by the electric motor (20) comprises a threaded hole (31') in the cam plug (40) for engaging threads on the motor shaft (31) and for thereby moving axially in response to rotation of the motor shaft (31).

9. The door lock according to claim 7, wherein the means for being moved axially comprises a spiral cam (45) operable by a tailpiece driver (61) on a key cylinder (60), the spiral cam (45) causing the cam plug (40) to move axially in response to rotary movement of the spiral cam (45).

10. The door lock according to claim 2, further comprising:

means for preventing disengagement of the means for locking the outside spindle (50, 150) against rotation by axial impacts to the outside spindle (50, 150).

11. The door lock according to claim 10, wherein the means for preventing disengagement of the means for locking the outside spindle (50, 150) against rotation by axial impacts to the outside spindle (50, 150) comprises:

an axial slot (156) in a mounting hub (155) fixed to the housing (80); and a circumferential slot (157) intersecting the axial slot (156) in the mounting hub (155) at an outboard end of the axial slot (156), the circumferential slot (157) extending substantially half-way around a circumference of the hub (155) such that, when located in the circumferential slot (157), the locking lug (41) is free to rotate with the spindle (150) to open the door lock, and, when located in the axial slot (156) inboard of the circumferential slot (157), the locking lug (41) and spindle (50, 150) are locked against rotation; the locking lug (41) being axially held in place by the biasing means (21).

12. The door lock according to claim 1, further comprising:

means for adjusting and presetting the biasing means (21, 109) against the resistance provided by which the motor (20, 102) is free to slide during operation.

13. The door lock according to claim 12, wherein the means for adjusting and presetting the biasing means (21) against which the motor (20) is free to slide during operation comprises:

an anchor member (120) fixed near an outboard end of the inside operator; and a threaded stud (100);

the biasing means (21) being attached at its inboard end to the motor (20), and the threaded stud (100) being rotatably connected between an outboard end of the biasing means (21) and the anchor member (120); the stud (100) being threadably engaged with one of the biasing means (21) and the anchor (120) and axially fixedly engaged with the other for adjusting the position of the motor (20) by the biasing means (21).

14. The door lock according to claim 1, further comprising:

a mechanical key cylinder (60) for operating the door lock.

15. The door lock according to claim 14, further comprising:

means for permitting locking and unlocking by the mechanical key cylinder (60) and the electric motor (20).

16. The door lock according to claim 2, wherein the housing (80) is a cylindrical lock chassis having inside and outside chassis walls upon which are mounted inside and outside hollow stationary hubs (15, 55) and through which project the inside and outside hollow spindles (10, 50), respectively, the spindles (10, 50) having latch rollback cams (12) at inner ends thereof, the means for preventing rotation of the outside operator includes a locking lug (41) and a hub locking slot (56, 156) in the outside hub (55, 155), the reversible electric motor (20) being disposed within the inside spindle (10) and coaxial therewith and the motor shaft (31) extending into the cylindrical lock chassis; and further comprising:

means for causing engagement and disengagement of the locking lug (41) with the hub locking slot (56, 156) and for thereby locking and unlocking the outside spindle (50) by using a mechanical key (C) in a key cylinder (60);

screw means connected directly to the motor shaft (31) for driving the locking lug (41) along the axis of the outside spindle (50) and for thereby causing engagement and disengagement of the locking lug (41) with the hub locking slot (56, 156); and means for transmitting signals to operate the motor (20) and to lock and unlock the outside spindle (50).

17. The door lock according to claim 4, wherein the means for preventing rotation comprises a stop works catch (7) slidably mounted in the case for movement in and out of engagement with a retractor hub (24).

18. The door lock according to claim 4, further comprising an adjustment means for adjustably connecting the motor (102) to the housing, the adjustment means permitting adjustment of the biasing means (109).

19. A linear actuator in a lock chassis for causing engagement and disengagement of a locking mechanism with a latch operating device, comprising:

a reversible electric motor (20, 102) having a longitudinal axis, disposed within the chassis and having a motor shaft (31, 106) operably engaged with the locking mechanism;

means for mounting the motor (20, 102) to the lock chassis in a rotationally rigid arrangement while providing linear freedom along the longitudinal axis of the motor;

screw means connected to the motor shaft (31, 106) for causing linear motion of the locking mechanism in response to rotary motion of the motor shaft (31, 106); and means for, during a hang-up condition of the locking mechanism, for storing rotary work of the motor (20, 102) as spring energy.

20. The linear actuator according to claim 19, further comprising:

a biasing means (21, 109) for linearly biasing the motor (20, 102).

* * * * *